US009404320B2

(12) United States Patent
Gilmore et al.

(10) Patent No.: US 9,404,320 B2
(45) **Date of Patent: *Aug. 2, 2016**

(54) RISER STRINGER HANG-OFF ASSEMBLY

(71) Applicant: Cameron International Corporation, Houston, TX (US)

(72) Inventors: David L. Gilmore, Baytown, TX (US); William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/825,034

(22) Filed: Aug. 12, 2015

(65) Prior Publication Data

US 2015/0345233 A1 Dec. 3, 2015

Related U.S. Application Data

(63) Continuation of application No. 13/274,962, filed on Oct. 17, 2011, now Pat. No. 9,109,404.

(51) Int. Cl.
*E21B 19/00* (2006.01)
*E21B 17/01* (2006.01)

(52) U.S. Cl.
CPC ..... *E21B 19/004* (2013.01); *E21B 17/01* (2013.01)

(58) Field of Classification Search
CPC ..... E21B 43/0107; E21B 19/004
USPC ..... 166/345, 348, 352, 359, 367, 382, 166/77.51, 85.1, 75.14; 405/184.4, 224.2, 405/224.4
See application file for complete search history.

(56) References Cited

U.S. PATENT DOCUMENTS 1,535,625 A * 4/1925 O'Bannon ..... E21B 19/06 292/52
1,766,920 A * 6/1930 Moody ..... E21B 19/06 294/91
2,009,942 A * 7/1935 Moody ..... E21B 19/06 294/91
2,048,209 A * 7/1936 Young ..... E21B 19/07 188/67
3,313,358 A * 4/1967 Postlewaite ..... E21B 7/128 166/355

(Continued)

FOREIGN PATENT DOCUMENTS

WO 0034619 6/2000
WO 0196706 12/2001

(Continued)

OTHER PUBLICATIONS

International Search Report and Written Opinion of PCT Application No. PCT/US2012/060253 dated Mar. 6, 2013: pp. 1-10.

*Primary Examiner* — Matthew R Buck
*Assistant Examiner* — Edwin Toledo-Duran
(74) *Attorney, Agent, or Firm* — Chamberlain Hrdlicka

(57) ABSTRACT

A hang-off assembly for supporting a riser string from an off-shore drilling rig. The hang-off assembly includes a housing with a passage through the housing and an open section allowing access to the entire length of the passage from outside the housing. The assembly also includes a gate member movable relative to the housing from an open position to a closed position, the gate member preventing access to the passage through the open section when in the closed position. A motor moves the gate member between the open and closed positions. An adapter attachable to the riser string includes a profile landable in the housing to support the riser string when connected to the adapter.

14 Claims, 10 Drawing Sheets

(56) References Cited

U.S. PATENT DOCUMENTS 3,333,562 A * 8/1967 Deal, Jr. ..... B63B 35/00 114/264
3,528,497 A * 9/1970 Lehman ..... E21B 7/128 166/360
3,791,442 A * 2/1974 Watkins ..... E21B 19/006 166/352
3,884,298 A * 5/1975 Watkins ..... E21B 7/128 166/351
4,275,488 A * 6/1981 Gray ..... E21B 19/10 188/67
4,279,542 A * 7/1981 Lewis, Jr. ..... E21B 43/0107 166/347
4,290,715 A 9/1981 Beynet et al.
4,505,614 A * 3/1985 Anschutz ..... E21B 17/1007 175/220
4,712,620 A * 12/1987 Lim ..... E21B 19/006 166/355
4,986,146 A * 1/1991 Buck ..... E21B 19/164 81/57.18
5,092,711 A * 3/1992 Langner ..... E21B 43/0107 166/341
5,318,385 A * 6/1994 Goulart ..... E21B 17/017 166/341
6,227,587 B1 * 5/2001 Terral ..... E21B 19/07 188/67
6,386,283 B1 * 5/2002 Mosing ..... E21B 19/10 166/75.14
6,422,316 B1 * 7/2002 Schutz ..... B63B 21/502 166/351
6,460,634 B1 * 10/2002 Hart ..... E21B 19/161 166/77.51
6,494,273 B1 * 12/2002 Martin ..... E21B 19/06 166/77.1
6,585,455 B1 * 7/2003 Petersen ..... E21B 19/006 166/355
6,644,409 B1 * 11/2003 Strømberg ..... E21B 19/004 166/241.1
6,708,766 B2 * 3/2004 Clark ..... E21B 41/0057 166/347
6,739,804 B1 * 5/2004 Haun ..... E21B 17/015 166/355
6,766,860 B2 * 7/2004 Archibald ..... E21B 19/143 166/341
6,793,019 B2 * 9/2004 Rodgers ..... F16L 1/26 166/340
6,869,253 B2 * 3/2005 Biolley ..... E21B 17/015 166/345
7,055,609 B2 * 6/2006 Hayes ..... E21B 19/06 166/380
7,063,485 B2 * 6/2006 Jordan ..... E21B 19/004 405/169
7,104,316 B1 * 9/2006 Hobgood ..... E21B 19/165 166/117.5
7,140,445 B2 * 11/2006 Shahin ..... E21B 7/20 166/380
7,163,061 B2 * 1/2007 Moncus ..... E21B 19/22 114/264
7,303,021 B2 * 12/2007 Schats ..... E21B 19/06 166/349
7,322,406 B2 * 1/2008 Wiggins ..... E21B 19/14 166/66
7,360,603 B2 * 4/2008 Springett ..... E21B 19/06 166/380
7,370,707 B2 * 5/2008 McDaniel ..... E21B 19/004 166/380
7,398,833 B2 * 7/2008 Ramey ..... E21B 19/10 166/382
7,416,025 B2 * 8/2008 Bhat ..... B63B 21/502 166/350
7,419,000 B1 * 9/2008 Marsh ..... E21B 19/10 166/380
7,461,700 B2 * 12/2008 Livingston, Jr. ..... E21B 19/10 166/379
7,571,772 B2 * 8/2009 Reams ..... E21B 17/01 166/344
7,628,225 B2 * 12/2009 Petersson ..... E21B 15/02 166/341
7,748,464 B2 * 7/2010 Bhat ..... B26B 21/502 166/350
7,762,343 B2 * 7/2010 Sonneveld ..... E21B 19/10 166/382
8,074,711 B2 * 12/2011 Ellis ..... E21B 19/07 166/77.51
8,141,923 B2 * 3/2012 Bouligny ..... E21B 19/07 294/102.2
8,240,391 B2 * 8/2012 Bouligny, Jr. ..... E21B 19/07 166/382
8,550,174 B1 * 10/2013 Orgeron ..... E21B 19/24 166/380
8,573,308 B2 * 11/2013 Baugh ..... E21B 19/004 166/355
8,601,910 B2 * 12/2013 Begnaud ..... E21B 19/164 166/77.51
9,109,404 B2 8/2015 Gilmore et al.
2004/0182297 A1 * 9/2004 Wybro ..... E21B 19/004 114/230.1
2004/0197152 A1 * 10/2004 Beard ..... E21B 19/004 405/224
2007/0056741 A1 * 3/2007 Finn ..... E21B 43/0107 166/367
2008/0210433 A1 9/2008 Bhat et al.
2008/0277108 A1 11/2008 Bouligny, Jr. et al.
2009/0252589 A1 10/2009 Sonneveld et al.
2010/0018716 A1 1/2010 Leonard et al.
2010/0054862 A1 * 3/2010 Brown ..... E21B 17/017 405/169
2012/0085552 A1 * 4/2012 Travis ..... E21B 33/0415 166/382
2013/0092390 A1 * 4/2013 Gilmore ..... E21B 19/004 166/367
2013/0098606 A1 * 4/2013 Webre ..... E21B 17/026 166/255.1
2013/0228339 A1 * 9/2013 Adams ..... E21B 19/002 166/348

FOREIGN PATENT DOCUMENTS

WO 2004055316 7/2004
WO 2005106185 11/2005
WO 2005118999 12/2005

* cited by examiner

RISER STRINGER HANG-OFF ASSEMBLY

BACKGROUND

Offshore oil and gas operations often utilize a wellhead housing supported on the ocean floor and a blowout preventer stack secured to the wellhead housing's upper end. A blowout preventer stack is an assemblage of blowout preventers and valves used to control well bore pressure. The upper end of the blowout preventer stack has an end connection or riser adapter (often referred to as a lower marine riser package or LMRP) that allows the blowout preventer stack to be connected to a series of pipes, known as riser, riser string, or riser pipe. Each segment of the riser string is connected in end-to-end relationship, allowing the riser string to extend upwardly to the drilling rig or drilling platform positioned over the wellhead housing.

The riser string is supported at the ocean surface by the drilling rig and extends to the subsea equipment through a moon pool in the drilling rig. A rotary table and associated equipment typically support the riser string during installation. Below the rotary table may also be a diverter, a riser gimbal, and other sensitive equipment.

During installation of the riser string, it may be necessary to temporarily move the entire drilling rig, such as for example when a strong storm is approaching Before moving the rig, it is necessary to pull up the entire riser. If the riser were left in place, movement of the rig would cause the riser string to damage the rotary table, diverter, gimbal, and other sensitive equipment. Pulling up each section of riser string takes a long time, adding cost to the overall drilling operations. Additionally, there may not be enough time to pull the entire riser string before the rig needs to be moved.

BRIEF DESCRIPTION OF THE DRAWINGS

For a detailed description of the preferred embodiments of the invention, reference will now be made to the accompanying drawings in which.

DETAILED DESCRIPTION

Figure 1A:
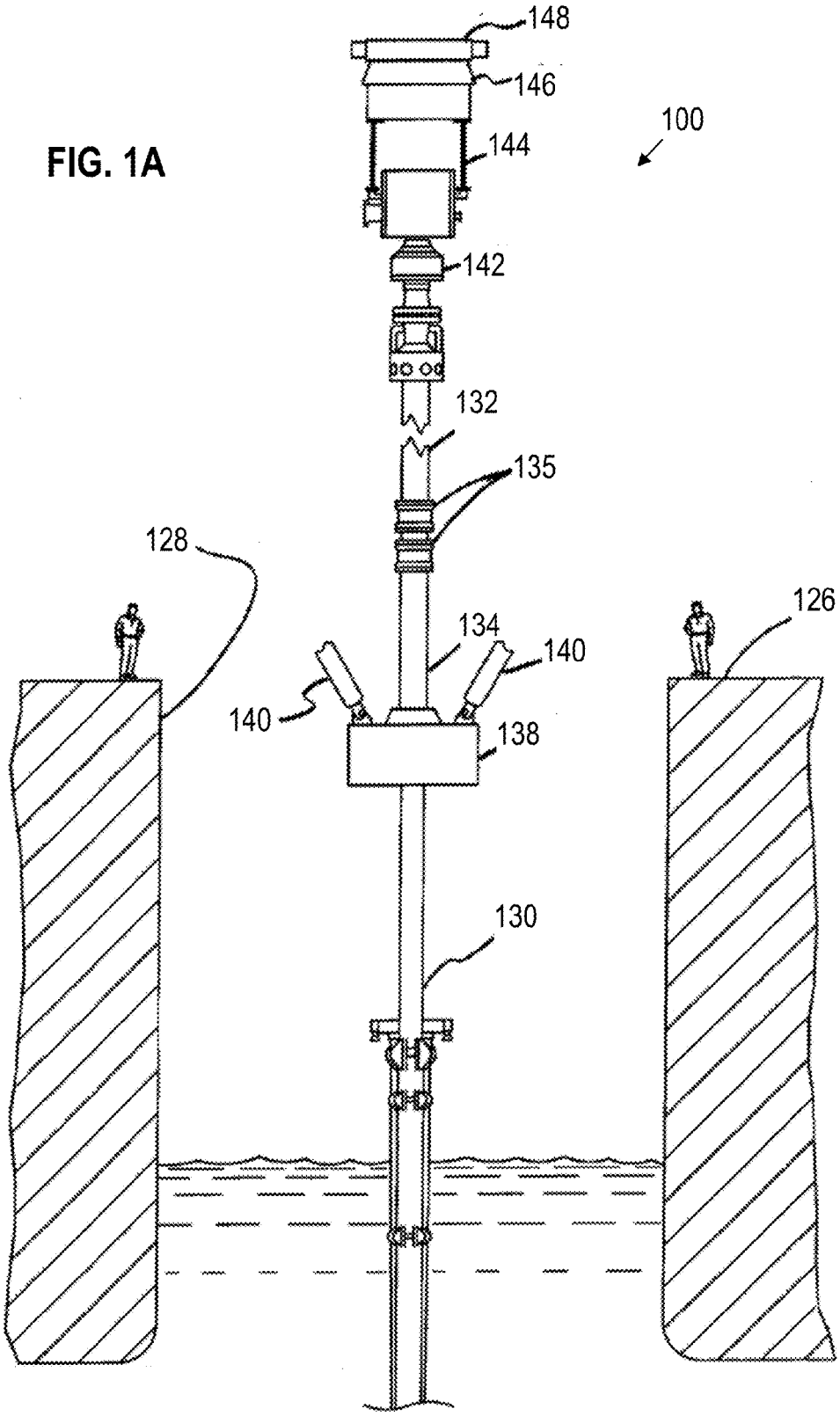
FIGS. 1A-1B show a drilling system.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 1B:
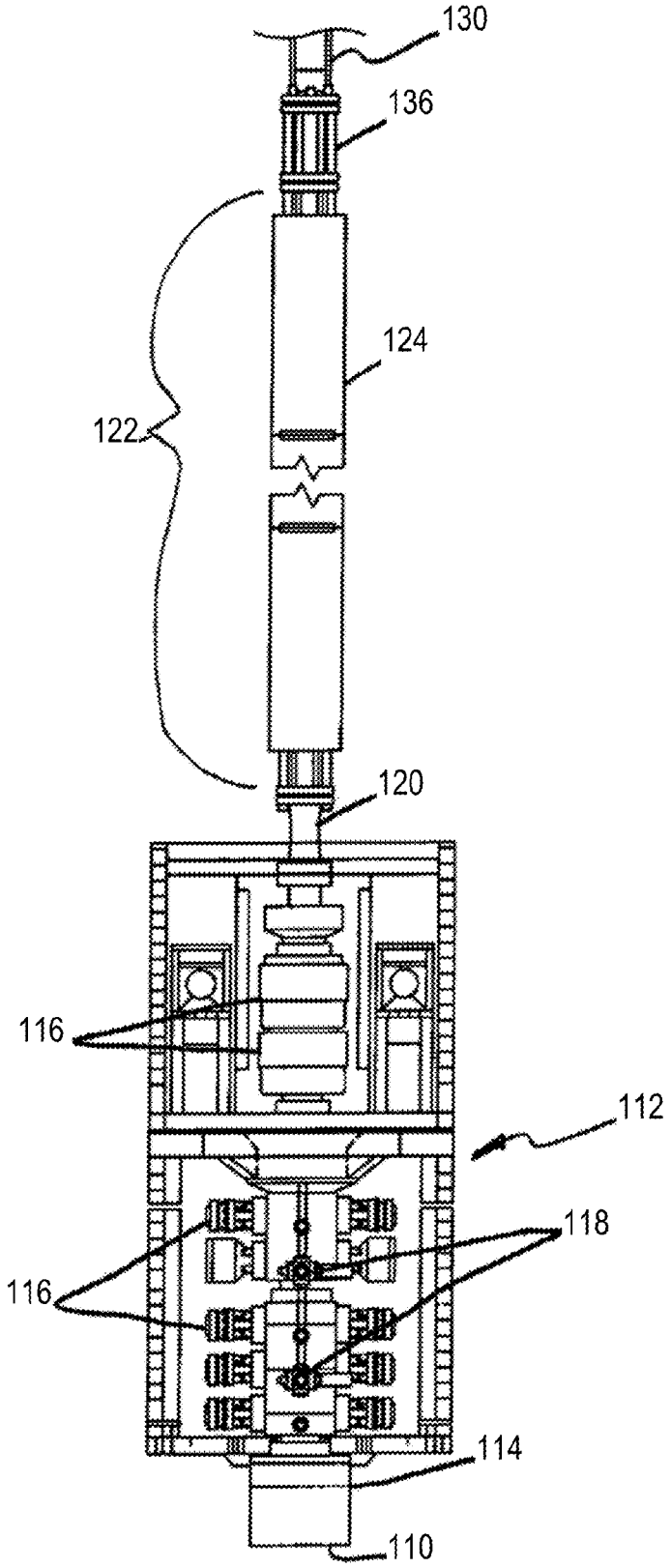

FIGS. 1A-1B show a drilling system 100 in accordance with various embodiments. The drilling system 100 includes a platform of a drilling rig 126 with a riser string 122 and a blowout preventer stack 112 used in oil and gas drilling operations connected to a wellhead housing 110. The wellhead housing 110 is disposed on the ocean floor and connected with the blowout preventer stack 112 with a hydraulic connector 114. The blowout preventer stack 112 includes multiple blowout preventers 116 and kill and choke valves 118 in a vertical arrangement to control well bore pressure in a manner known to those of skill in the art. Disposed on the upper end of the blowout preventer stack 112 is a riser adapter 120 to allow connection of the riser string 122 to the blowout preventer stack 112. The riser string 122 is composed of multiple sections of pipe or riser joints 124 connected end to end and extending upwardly to the drilling rig 126.

Drilling rig 126 further includes a moon pool 128 having a telescoping joint 130 disposed therein. The telescoping joint 130 includes a inner barrel 132 which telescopes inside an outer barrel 134 to allow relative motion between the drilling rig 126 and the wellhead housing 110. A dual packer 135 is disposed at the upper end of the outer barrel 134 and seals against the exterior of inner barrel 132. A landing tool adapter joint 136 is connected between the upper end of the riser string 122 and the outer barrel 134 of the telescoping joint 130. A tension ring 138 is secured on the exterior of the outer barrel 134 and connected by tension lines 140 to a hydraulic tensioning system as known to those skilled in the art. This arrangement allows tension to be applied by the hydraulic tensioning system to the tension ring 138 and the telescoping joint 130. The tension is transmitted through the landing tool adapter joint 136 to the riser string 122 to support the riser string 122. The upper end of the inner barrel 132 is terminated by a flex joint 142 and a diverter 144 connecting to a gimbal 146 and a rotary table spider 148.

Before, and even after installation of the riser string 122 to the subsea equipment, it may become necessary to detach the riser string 122 from the diverter 144, the gimbal 146, rotary table 148, and any other sensitive equipment. For example, the drilling rig 126 may need to be moved from one location to another and movement of the drilling rig 126 relative to the riser would damage the equipment. In such cases, instead of pulling up and dismantling the entire riser string 122, the drilling rig 126 may include a hang-off assembly 200 as shown in FIGS. 2-9 to support the riser string 122 after it is detached from the diverter 144 and other equipment.

As shown in FIGS. 2-6, the hang-off assembly 200 includes a housing 210 with a passage 220 through the housing 210 and an open section 212 allowing access to the entire length of the passage 220 through the side of the housing 210 from the outside. As shown, the housing 210 is mountable to a support structure 211 that may be mounted anywhere on the rig 126 appropriate for supporting the riser sting 122. The housing 210 also includes an optional cover 214 shown as transparent in the figures. The cover 214 protects the housing and the other components described below.

Figure 2:
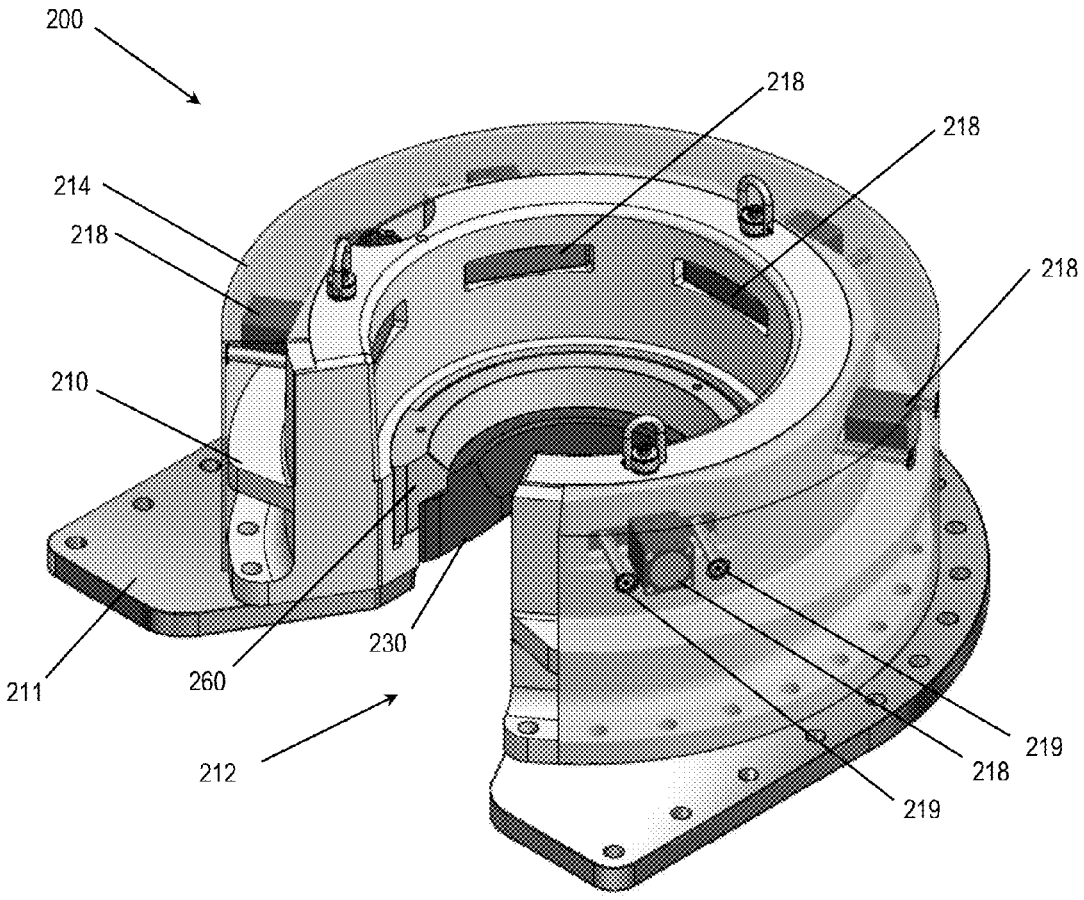
FIG. 2 is a perspective view of a hang-off assembly in an open position in accordance with various embodiments.
Figure 3:
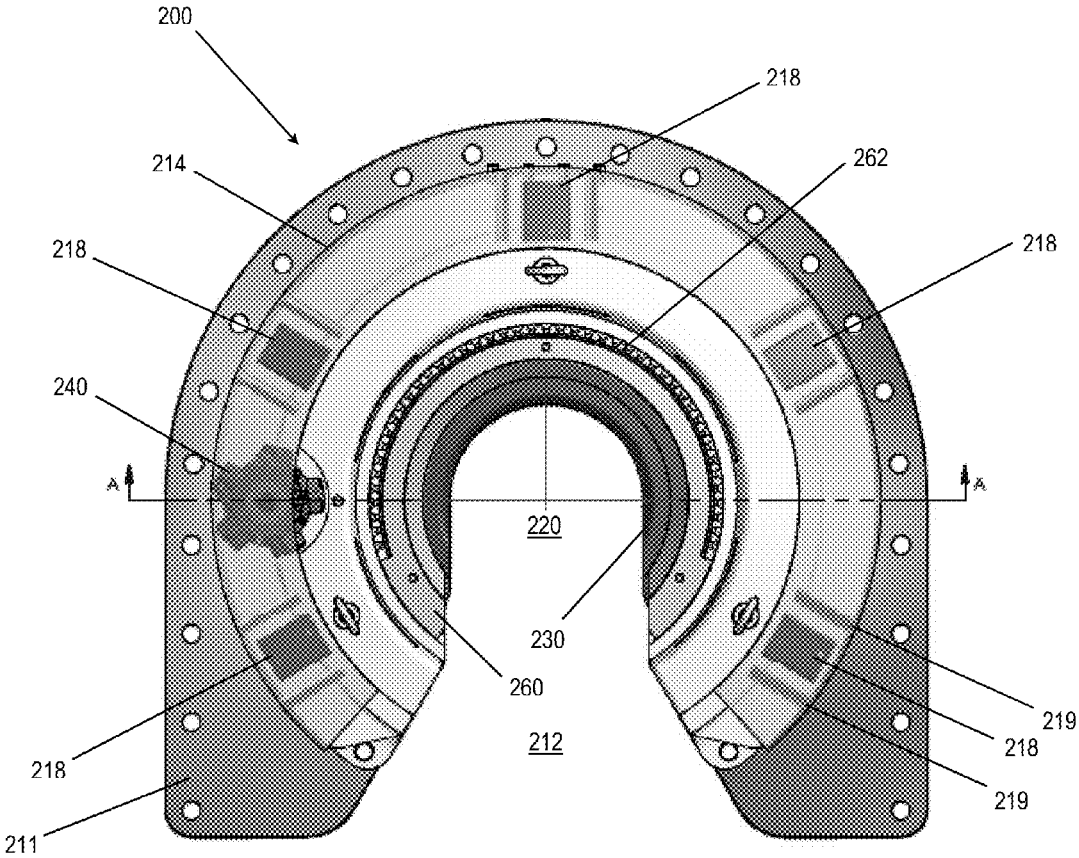
FIG. 3 shows top view of the hang-off assembly of FIG. 2.
Figure 4:
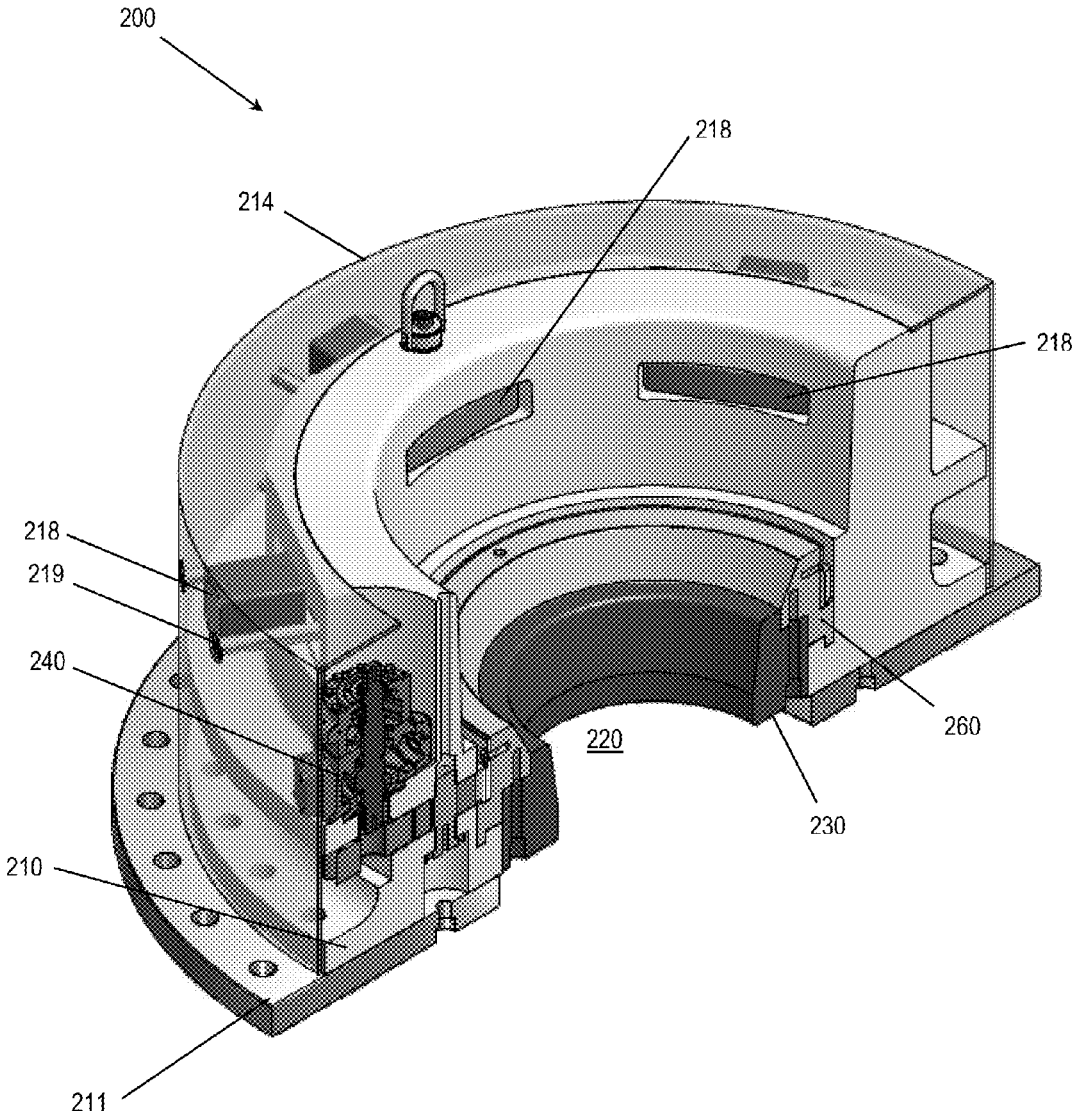
FIG. 4 shows a perspective view of the hang-off assembly of FIG. 2 shown cutaway in a plane A-A of FIG. 3.
Figure 5:
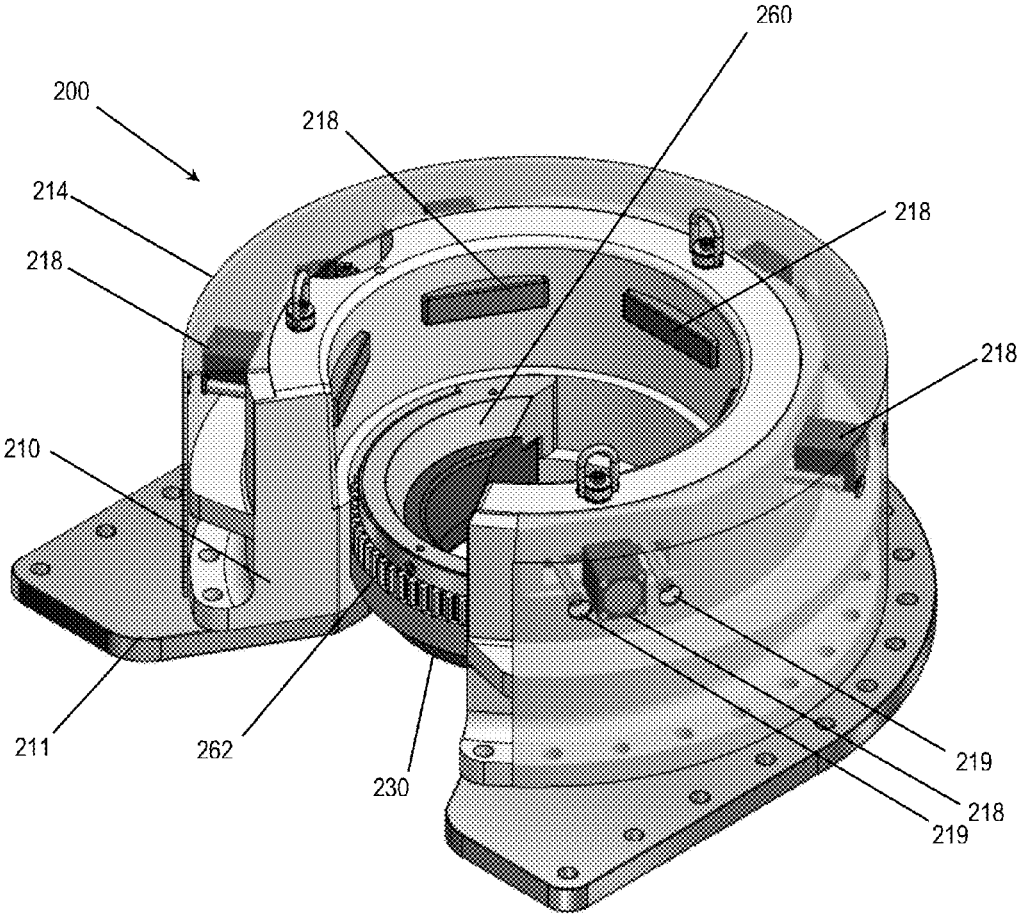
FIG. 5 shows a perspective view of the hang-off assembly in a closed position.
Figure 6:
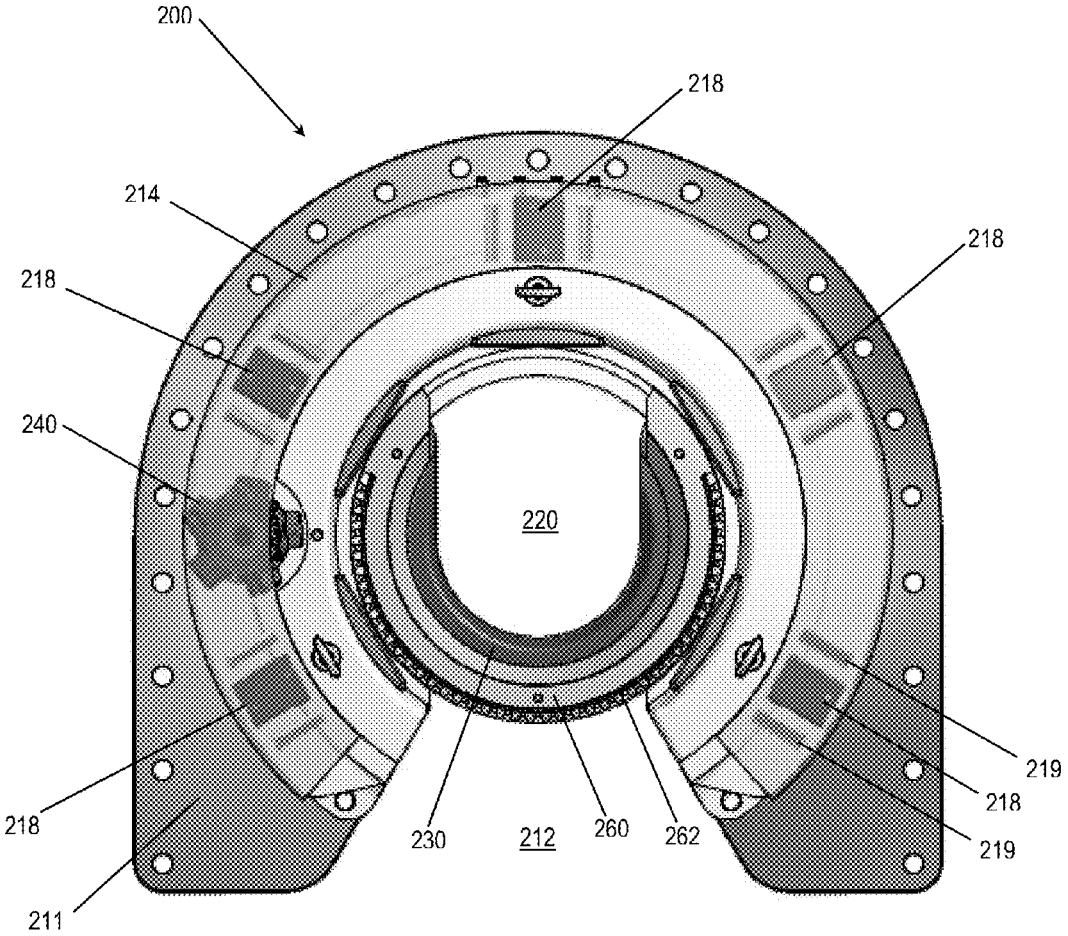
FIG. 6 shows a top view of the hang-off assembly in the closed position.

The assembly 200 also includes a gate member 260 movable relative to the housing 210 from an open position shown in FIGS. 2-4 to a closed position shown in FIGS. 5 and 6. The gate member 260 prevents access to the passage 220 through the open section 212 when in the closed position. Preferably, the housing 210, the passage 220, and the gate member 260 are curved and the gate member 260 rotates between the open and the closed positions. However, the housing 210 and the gate member 260 can be any suitable configuration, such as a sliding gate. The assembly 200 further includes an alignment member 230 for accepting the riser string 122 as described below. As shown, the alignment member 230 is connected to the gate member 260 using fasteners such as bolts. Alternatively, the alignment member 230 and the gate member 260 may not be connected to each other. The alignment member 230 may also be integral with the housing 210 or the gate member 260.

The assembly 200 also includes a motor 240 that moves the gate member 260 between the open and closed positions. In some embodiments, the motor 240 is a hydraulic drive motor. In some embodiments, the motor 240 is an electric drive motor. As shown, the motor 240 includes a gear that engages an exterior gear profile 262 on the gate member 260. The motor 240 turns the motor gear to apply force to the exterior gear profile. This force moves the gate member 260 and the alignment member 230 between the closed and open positions. Alternatively, the motor 240 may engage a gear profile on the alignment member 230. Also alternatively, the alignment member 230 need not move with the gate member 260.

Figure 7:
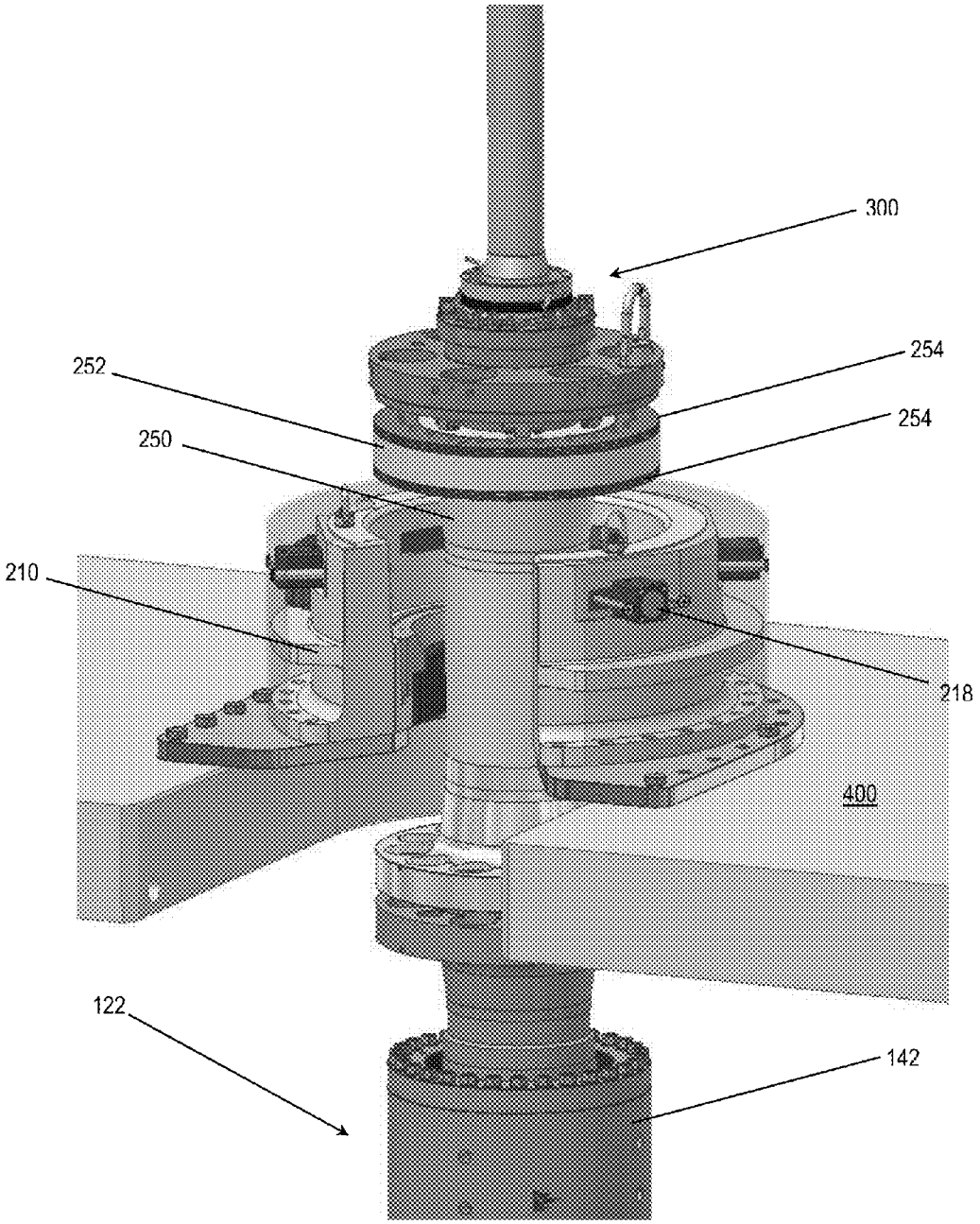
FIGS. 7-9 show a sequence of landing a riser string in the hang-off assembly and locking it in place.
Figure 8:
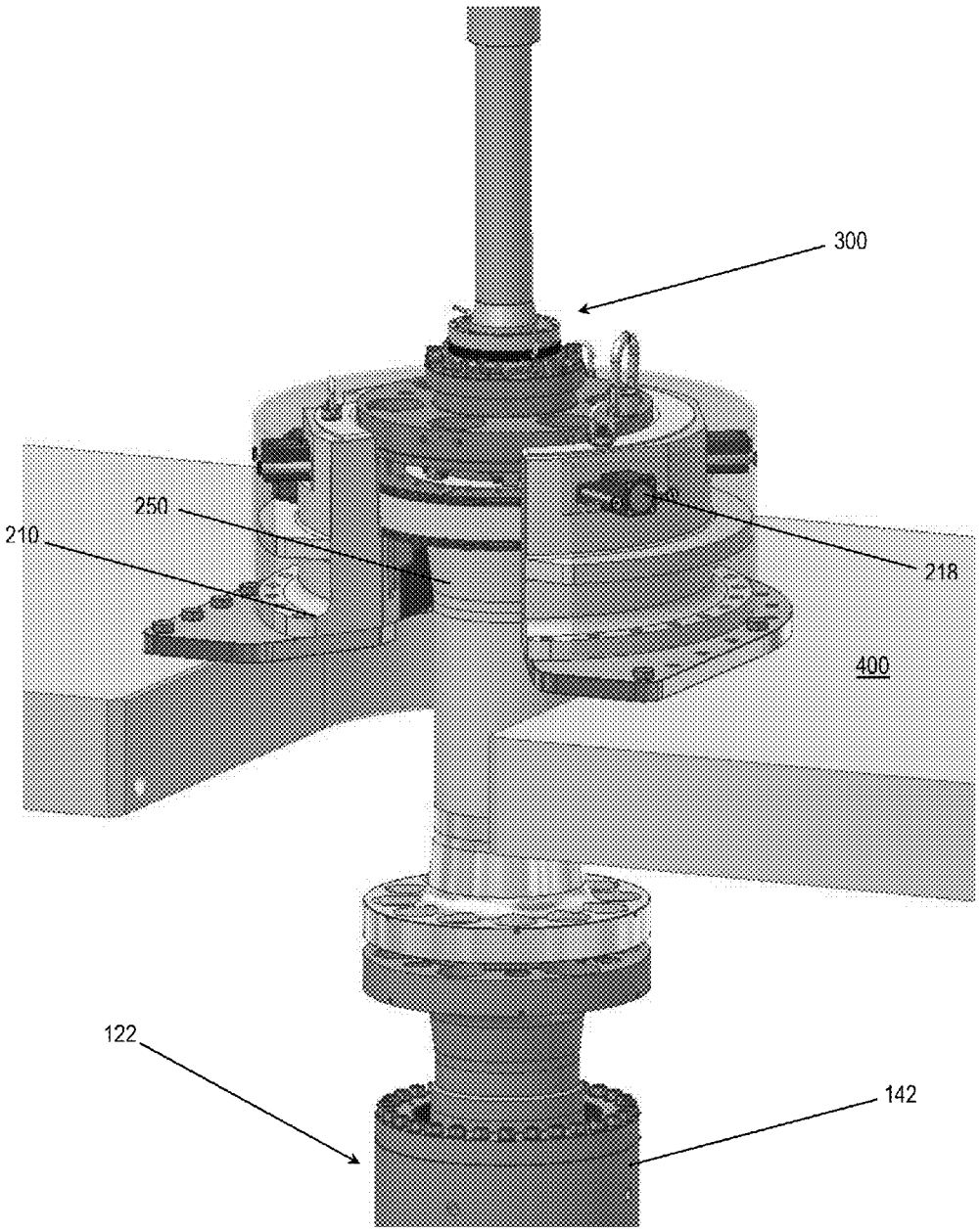
Figure 9:
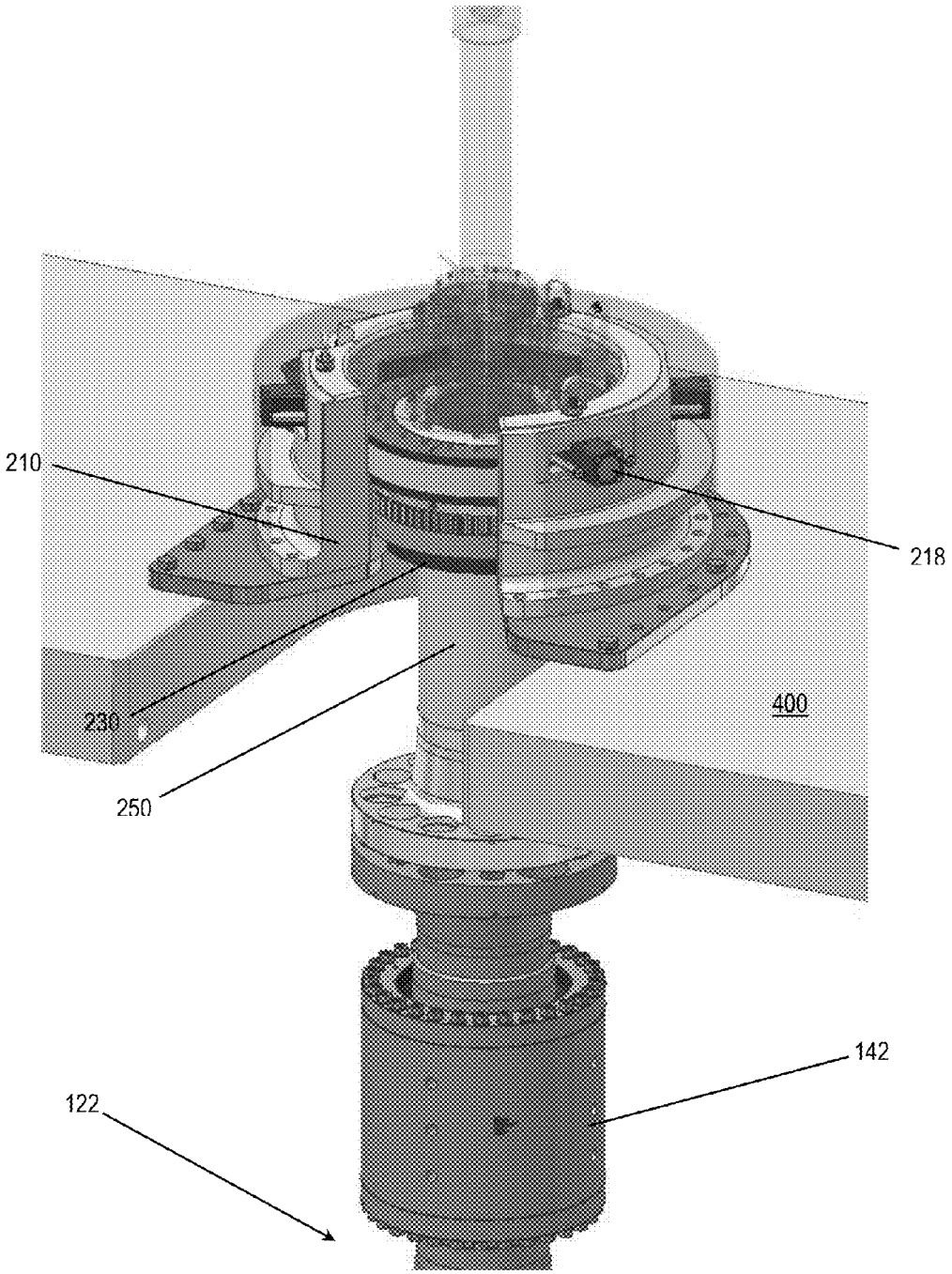

Shown in FIGS. 7-9, the assembly 200 also includes an adapter 250 attachable to the riser string 122. The adapter includes a profile 252 landable in the housing 210 to support the riser string 122. The adapter profile 252 enables the adapter 250 to land in the housing 210 and be supported by the gate member 260 to support the riser string 122. As shown, the adapter profile 252 includes at least one shock absorber 254 to absorb impact forces between the adapter 250 and the housing 210 when landing and while landed in the housing 210.

The housing further includes one or more locking mechanisms 218 that engage the adapter 250 to secure the adapter 250 to the housing once landed. In some embodiments, the locking mechanisms 218 are hydraulically operated. In other embodiments, the locking mechanisms 218 are mechanically operated. The locking mechanisms 218 may be either hydraulically or mechanically operated in some embodiments. Shown in the figures are examples of hydraulically operated locking mechanisms 218 that include a slide actuated between locked and unlocked positions with a hydraulic piston. Lock state indicators 219 identify the locking mechanism 218 as locked or not locked. For example, extended indicators 219 indicate a locked state, and retracted indicators indicate an unlocked state. Additional back-up or secondary locking mechanisms may also be included.

FIGS. 7-9 show a landing and locking sequence for the hang-off assembly 200. In this embodiment, the hang-off assembly 200 is attached to a platform 400 on the drilling rig 126 in a location suitable to hang the riser string 122, such as through the drilling rig moon pool 128. As shown, the riser string 122 and the flex joint 142 are detached from the diverter 144, the gimbal 146, and the rotary table spider 148. The riser adapter 250 is attached to the flex joint 142 using a connection flange on the adapter 250. A riser string running tool 300 is attached to the adapter 250 opposite the riser string 122. The riser string running tool 300 is used on the drilling rig to support and move the riser string 122.

With the gate member 260 located in the open position, the riser string running tool 300 moves the adapter 250 and the riser string 122 into the passage 220 through the open section 212 in the side of the housing 210. Once in the passage 220, the adapter 250 is landed such that the adapter profile 252 is supported on the gate member 260 as shown in FIG. 8. During landing, the alignment member 230 helps align the riser string 122 and also protects the gate member 260 by absorbing some of the impact forces from the moving riser string 122. The bottom shock absorber 254 on the adapter profile 252 absorbs some of the landing forces to help protect the adapter 250. The motor 240 is then used to move the gate member 260 into the closed position along with the alignment member 230 as shown in FIG. 9. Alternatively, the motor 240 can move the gate member 260 and the alignment member 230 into the closed position before the adapter 250 is landed. Once the adapter 250 is landed, the locking mechanisms 218 are actuated to lock the adapter 250 into place in the housing 210. As shown in FIG. 9, the slides of the locking mechanisms fit over the top shock absorber 254 on the adapter profile 252 to engage the adapter 250. The top shock absorber 254 thus absorbs some of the impact forces from the slides if the riser string 122 moves within the housing 210. Also as shown in FIG. 9, when the locking mechanisms 218 are in the locked position, the lock state indicators 219 are extended. With the riser string 122 locked in the hang-off assembly 200, the rig may now move to a different location while the riser string 122 remains hung below the platform 400.

Although the present invention has been described with respect to specific details, it is not intended that such details should be regarded as limitations on the scope of the invention, except to the extent that they are included in the accompanying claims.

What is claimed is:

1. A method for hanging a riser string off an offshore drilling rig, the method comprising:

supporting a housing from the rig;

coupling an adapter to the riser string, the adapter including a profile;

landing the adapter in the housing; and moving a gate member located on the housing from an open position to a closed position, wherein the adapter is supportable by the gate member in the open and closed positions.

2. The method of claim 1, further comprising moving the gate member to the open position; and removing the adapter from the housing.

3. The method of claim 1, wherein, in the open position, the housing includes a passage through the housing and an open section allowing access to the passage through the side of the housing.

4. The method of claim 3, wherein the housing, the passage, and the gate member are curved and the gate member rotates between the open and the closed positions.

5. The method of claim 1, wherein moving the gate member includes using a motor to move the gate member to the closed position.

6. The method of claim 1, wherein moving the gate member includes using a hydraulic drive motor to move the gate member to the closed position.

7. The method of claim 1, wherein landing the adapter comprises aligning the adapter in the housing via an alignment member configured to position the adapter when landed in the housing.

8. The method of claim 7, further comprising absorbing at least some impact forces, resulting when landing the adapter in the housing, with the alignment member.

9. The method of claim 7, wherein the alignment member is attached to and moves with the gate member.

10. The method of claim 1, further comprising securing the adapter to the housing via a locking mechanism that engages the adapter.

11. The method of claim 10, wherein the locking mechanism is hydraulically actuated.

12. The method of claim 10, further comprising indicating whether the locking mechanism is engaged or not engaged with the adapter via a locking indicator.

13. The method of claim 1, further comprising absorbing impact forces, resulting from landing the adapter in the housing, via a shock absorber located on the adapter profile.

14. The method of claim 1, wherein supporting the housing from the rig includes mounting the housing directly to the rig.

* * * * *